US012480733B2

(12) United States Patent
Lee et al.

(10) Patent No.: US 12,480,733 B2
(45) Date of Patent: Nov. 25, 2025

(54) FIREARM LOWER RECEIVER EXTENSION VISE FIXTURE

(71) Applicant: Strike IP, LLC, Las Vegas, NV (US)

(72) Inventors: Shanyao Lee, Las Vegas, NV (US); Felix Danishwara, Las Vegas, NV (US)

(73) Assignee: Strike IP, LLC, Las Vegas, NV (US)

( * ) Notice: Subject to any disclaimer, the term of this patent is extended or adjusted under 35 U.S.C. 154(b) by 0 days.

(21) Appl. No.: 18/946,903

(22) Filed: Nov. 13, 2024

(65) Prior Publication Data

US 2025/0155216 A1 May 15, 2025

Related U.S. Application Data

(60) Provisional application No. 63/599,464, filed on Nov. 15, 2023.

(51) Int. Cl.
*F41A 23/18* (2006.01)
*F41A 3/66* (2006.01)

(52) U.S. Cl.
CPC ..... *F41A 23/18* (2013.01); *F41A 3/66* (2013.01)

(58) Field of Classification Search
CPC .. F41A 23/18; F41A 3/66; F41A 11/00; F41A 11/02
See application file for complete search history.

(56) References Cited

U.S. PATENT DOCUMENTS

| | | | | |
|---|---|---|---|---|
| 2,731,829 | A * | 1/1956 | Wigington et al. | F41A 23/16 73/167 |
| 6,761,101 | B1 * | 7/2004 | Luth | B25B 1/2457 269/54.5 |
| 8,209,896 | B1 * | 7/2012 | Cashwell | F41C 27/00 269/47 |
| 9,372,041 | B1 * | 6/2016 | Geissele | F41A 35/00 |
| 11,788,812 | B1 * | 10/2023 | Harrison | F41A 23/18 42/94 |
| 2016/0202014 | A1 * | 7/2016 | Geissele | F41A 23/18 269/287 |
| 2019/0162499 | A1 * | 5/2019 | Jacobson | F41A 23/18 |
| 2020/0141683 | A1 * | 5/2020 | Jacobson | F41A 23/18 |
| 2020/0370853 | A1 * | 11/2020 | Jacobson | F41A 11/00 |
| 2020/0408479 | A1 * | 12/2020 | Attanasio, Jr. | F41A 23/04 |
| 2021/0114174 | A1 * | 4/2021 | Parra | B25B 1/2457 |
| 2022/0281076 | A1 * | 9/2022 | Morris | B60R 7/14 |
| 2024/0300071 | A1 * | 9/2024 | Parris | F41G 11/003 |
| 2025/0035394 | A1 * | 1/2025 | Hamersley | F41A 11/02 |

* cited by examiner

*Primary Examiner* — Joshua E Freeman
(74) *Attorney, Agent, or Firm* — Andy M. Han; Han IP PLLC

(57) ABSTRACT

An apparatus implementable on a firearm includes a fixture base and a fixture neck. The fixture base is configured to be attached to a location on a lower receiver of the firearm where a pistol grip is mounted when the firearm is in operation. The fixture neck is configured to be slidingly received by the fixture base while an extension portion of the firearm traverses through a through hole or hollow of the fixture neck.

18 Claims, 5 Drawing Sheets

FIREARM LOWER RECEIVER EXTENSION VISE FIXTURE

CROSS-REFERENCE TO RELATED PATENT APPLICATION(S)

The present disclosure is part of a non-provisional application claiming the priority benefit of U.S. Patent Application 63/599,464, filed 15 Nov. 2023, the content of which being incorporated by reference in its entirety.

TECHNICAL FIELD

The present disclosure is generally related to firearm accessories and, more particularly, to a firearm lower receiver extension vise fixture.

BACKGROUND

Unless otherwise indicated herein, approaches described in this section are not prior art to the claims listed below and are not admitted as prior art by inclusion in this section.

For an AR-15 or AR-10 style firearm, a lower receiver vise block allows a user to mount the firearm's lower receiver to a vise block for securing the lower receiver to a bench vise. With the vise block inserted into a hollow of the lower receiver, the user can firmly clamp the vise block with a vise without the risk of scratching, crushing, or otherwise damaging the lower receiver. This allows the user to perform maintenance, repair and/or disassembly/assembly of the firearm.

However, in jurisdictions where the rules and regulations cause users of firearms to permanently or semi-permanently fix a cartridge magazine in the lower receiver of an AR-15 or AR-10 style firearm, it tends to be inconvenient and time consuming for a user to dismantle or otherwise remove the magazine so as to allow insertion of a vise block into the hollow of the lower receiver should there is a need for the user to mount the lower receiver on a vise to perform upkeep, maintenance, repair or other tasks regarding the lower receiver or firearm. Therefore, there is a need for a solution of a firearm lower receiver extension vise fixture.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issues, an objective of the present disclosure is to propose innovative designs of a reflex sight with a firearm lower receiver extension vise fixture. It is believed that the proposed designs can avoid or otherwise minimize aforementioned issue associated with conventional reflex sights.

In one aspect, an apparatus implementable on a firearm may include a fixture base and a fixture neck. The fixture base may be configured to be attached to a location on a lower receiver of the firearm where a pistol grip is mounted when the firearm is in operation. The fixture neck may be configured to be slidingly received by the fixture base while an extension portion of the firearm traverses through a through hole or hollow of the fixture neck.

In another aspect, an apparatus implementable on a firearm may include a fixture base and a fixture neck. The fixture base may be configured with a lower portion and an upper portion. The fixture base may also be configured to be attached to a lower receiver of the firearm. The fixture neck may be configured with a first distal end and a second distal end opposite the first distal end. The fixture neck may also be configured with a through hole or hollow near the first distal end. The fixture neck may further be configured with ledges or extrudes protruding from opposite sides of the second distal end, such that, with the fixture base attached to the lower receiver, the fixture neck may be configured to be movably received in the upper portion of the fixture base while: (a) the ledges or extrudes are slidingly received in slots on opposite inner walls of the upper portion of the fixture base, and (b) an extension portion of the firearm traverses through the through hole or hollow of the fixture neck.

In yet another aspect, an apparatus implementable on a firearm may include a fixture base, a fixture neck, an adjustable collar and an adjustable screw. The fixture base may be configured to be attached to a location on a lower receiver of the firearm where a pistol grip is mounted when the firearm is in operation. The fixture neck may be configured to be slidingly received by the fixture base while a buffer tube of the firearm traverses through a through hole or hollow of the fixture neck. The adjustable collar may be configured to be received in a groove or indentation on an inner wall of the through hole or hollow of the fixture neck. The adjustment screw may be configured to move a position of the adjustable collar in the through hole or hollow of the fixture neck to tighten or loosen a grip on the buffer tube by the fixture neck and the adjustable collar.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
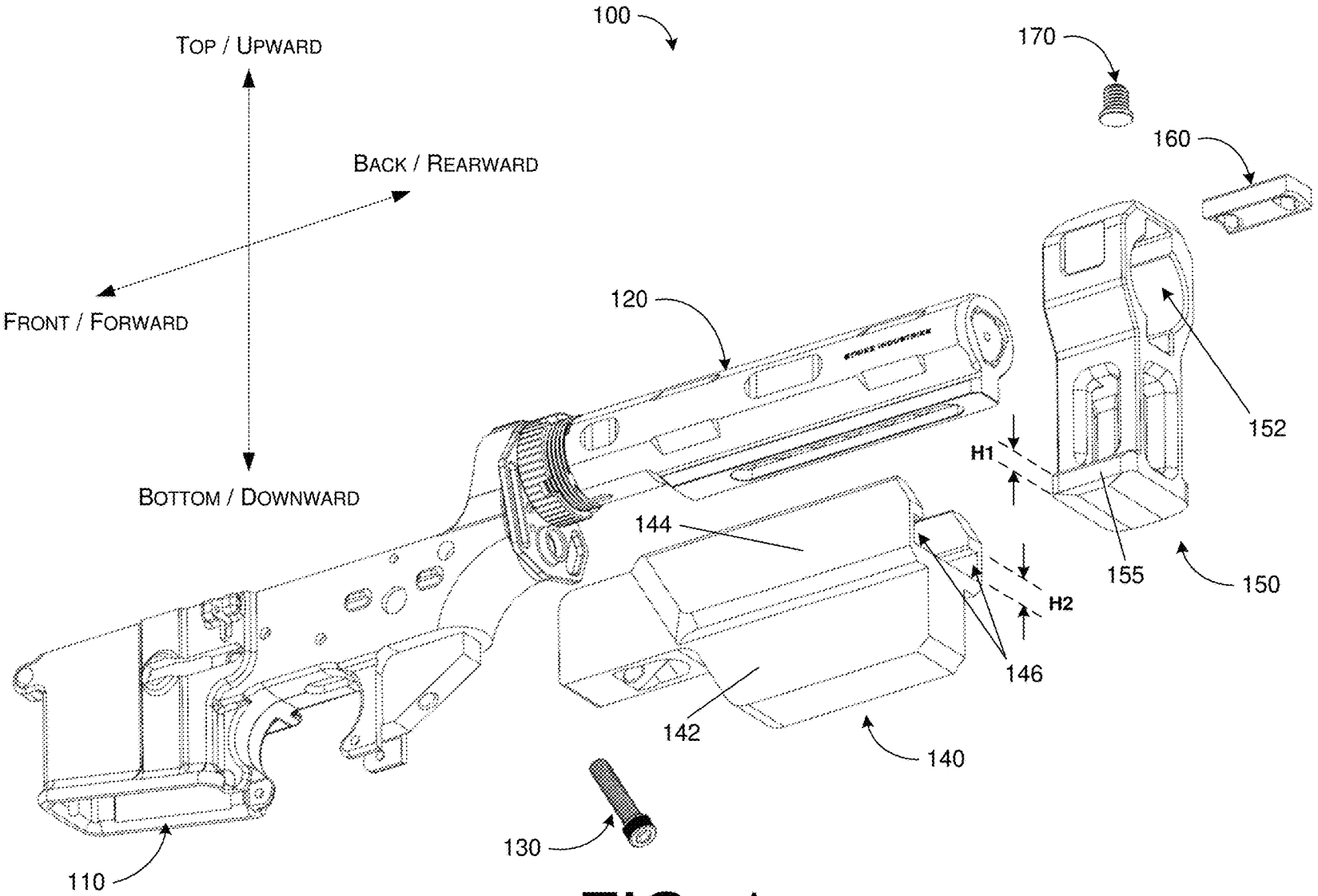
FIG. 1 is a diagram of an example apparatus under a proposed scheme in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g., 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

Under the various proposed schemes in accordance with the present disclosure, a firearm lower receiver extension vise fixture may include two main parts, including a fixture base and a fixture neck. When in use, the fixture base may be secured by a screw onto a grip section of a lower receiver of a firearm (e.g., an AR-15 or AR-10 style rifle, carbine or pistol). The fixture neck may have a hole through which a firearm receiver extension can traverse. Moreover, the fixture neck may slide into the fixture base. Furthermore, there may be a neck adjustable collar configured to adjust a tightness between the fixture neck and the firearm receiver extension.

FIG. 1 illustrates an example apparatus 100 under a proposed scheme in accordance with the present disclosure. Referring to FIG. 1, example apparatus 100 may include an AR-15 or AR-10 style firearm or at least a lower assembly of the AR-15 or AR-10 style firearm, which may include a lower receiver 110, an extension portion 120 of the firearm (e.g., buffer tube), a grip screw 130 (which may be an existing grip screw used to secure a pistol grip or another type of grip onto the lower receiver), a fixture base 140, a fixture neck 150, a neck adjustable collar 160, and an adjustment screw 170. Although not shown in FIG. 1, an adjustment wrench may be used by a user to turn the adjustment screw 170 to adjust a position of the neck adjustable collar 160 (e.g., to move upward or downward with respect to fixture neck 150 or, put differently, to move farther away from or closer to the groove or indentation on the inner wall of the through hole/hollow of the fixture neck 150). In some implementations, the adjustment wrench may be a Torx wrench and the adjustment screw 170 may correspondingly be a Torx screw. In other implementations, the adjustment wrench may be another type of wrench (e.g., Allen wrench, Hex wrench or a different type of wrench) and the adjustment screw 170 may correspondingly be that type of screw (e.g., Allen screw, Hex screw or a different type of screw).

Referring to FIG. 1, the fixture base 140 may be configured with a lower portion 142 and an upper portion 144. The fixture base 140 may also be configured to be attached to the lower receiver 110 of the firearm. The fixture neck 150 may be configured with a first distal end (e.g., the upper end shown in FIG. 1) and a second distal end (e.g., the lower end shown in FIG. 1) opposite the first distal end. The fixture neck 150 may also be configured with a through hole or hollow 152 near the first distal end. The fixture neck 150 may further be configured with ledges or extrudes 155 protruding from opposite sides of the second distal end, such that, with the fixture base 140 attached to the lower receiver 110, the fixture neck 150 may be configured to be movably received in the upper portion 144 of the fixture base 140 while: (a) the ledges or extrudes 155 are slidingly received in slots 146 on opposite inner walls of the upper portion 144 of the fixture base 140, and (b) an extension portion of the firearm (e.g., buffer tube 120) traverses through the through hole or hollow 152 of the fixture neck. In some implementations, a height H2 of the slots 146 on opposite inner walls of the upper portion 144 may be sufficiently larger than a height H1 of the ledges or extrudes 155 on the second distal end of fixture neck 150 so as to create a sufficient gap tolerance therebetween when the ledges or extrudes 155 are slidingly received in the slots 146. Advantageously, this gap tolerance may render apparatus 100 versatile in application in that apparatus 100 (or, at least fixture base 140 and fixture neck 150) may fit or be used on firearms of both the AR-15 and AR-10 styles. For instance, a user may use the same fixture base 140 and fixture neck 150 on one or more AR-15 firearms as well as one or more AR-10 firearms (which have larger dimensions of those of AR-15 firearms) without having to purchase or own two (e.g., one for AR-15 and the other for AR-10). That is, the gap tolerance may be sufficiently large to allow fixture base 140 and fixture neck 150 to be used on firearms of different types and/or sizes.

Figure 2:
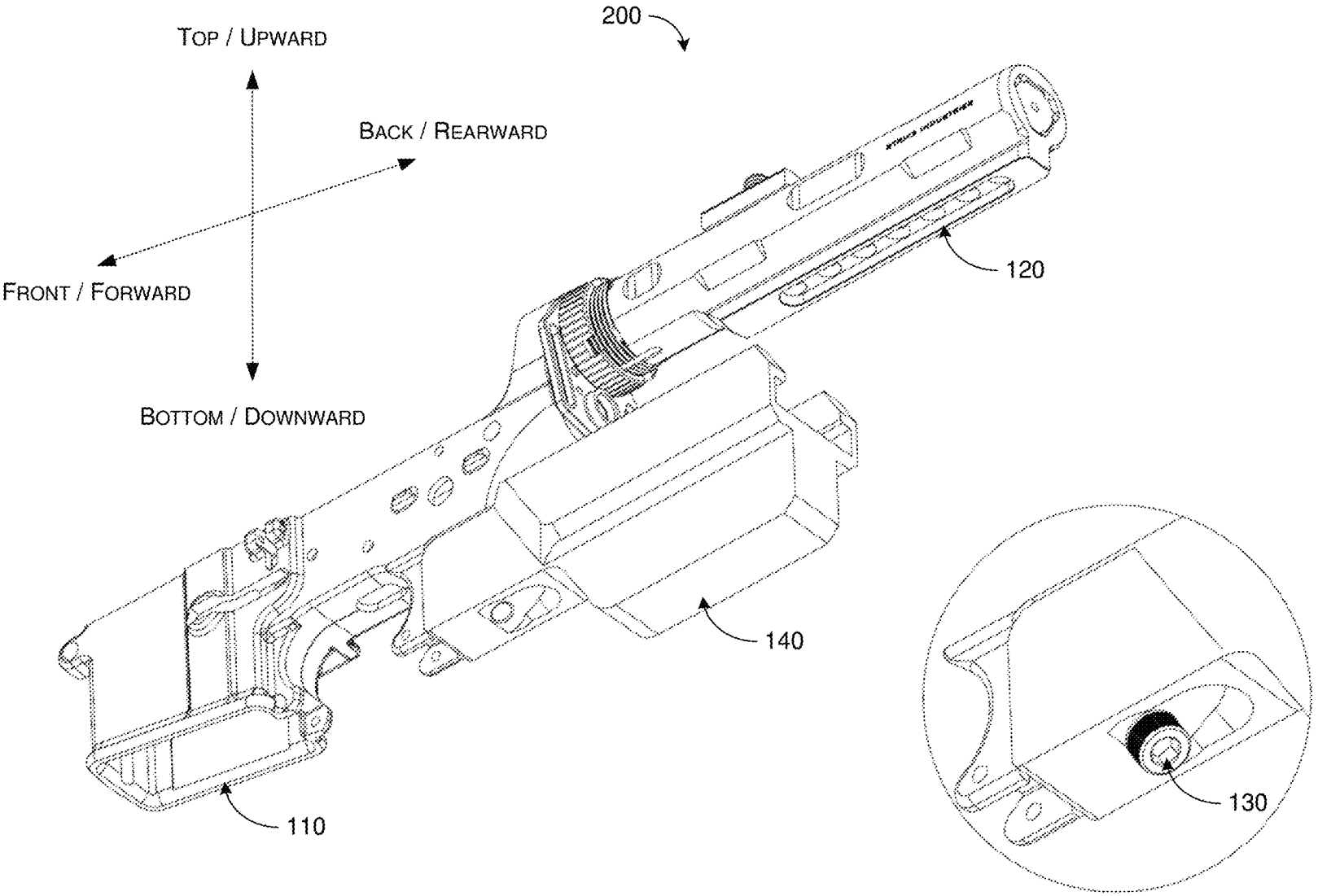
FIG. 2 is a diagram of an example scenario under a proposed scheme in accordance with an implementation of the present disclosure.

FIG. 2 illustrates an example scenario 200 as part of a process of assembling example assembly 100 under a proposed scheme in accordance with the present disclosure.

Referring to FIG. 2, with the pistol grip (or another type of grip) removed from the lower receiver of the AR-15 or AR-10 style firearm, thereby exposing a screw hole used to secure the grip onto the lower receiver with the grip screw 130, the fixture base 140 may be installed, attached or otherwise mounted onto the lower receiver 110 of the AR-15 or AR-10 style firearm by screwing the grip screw 130 into the screw hole through an opening (e.g., a round hole) on the fixture base 140. In other words, the fixture base 140 may be installed, attached or otherwise mounted onto the lower receiver 110 at a location where the pistol grip (or another type of pistol) is designed to be when the firearm was in operation.

Figure 3:
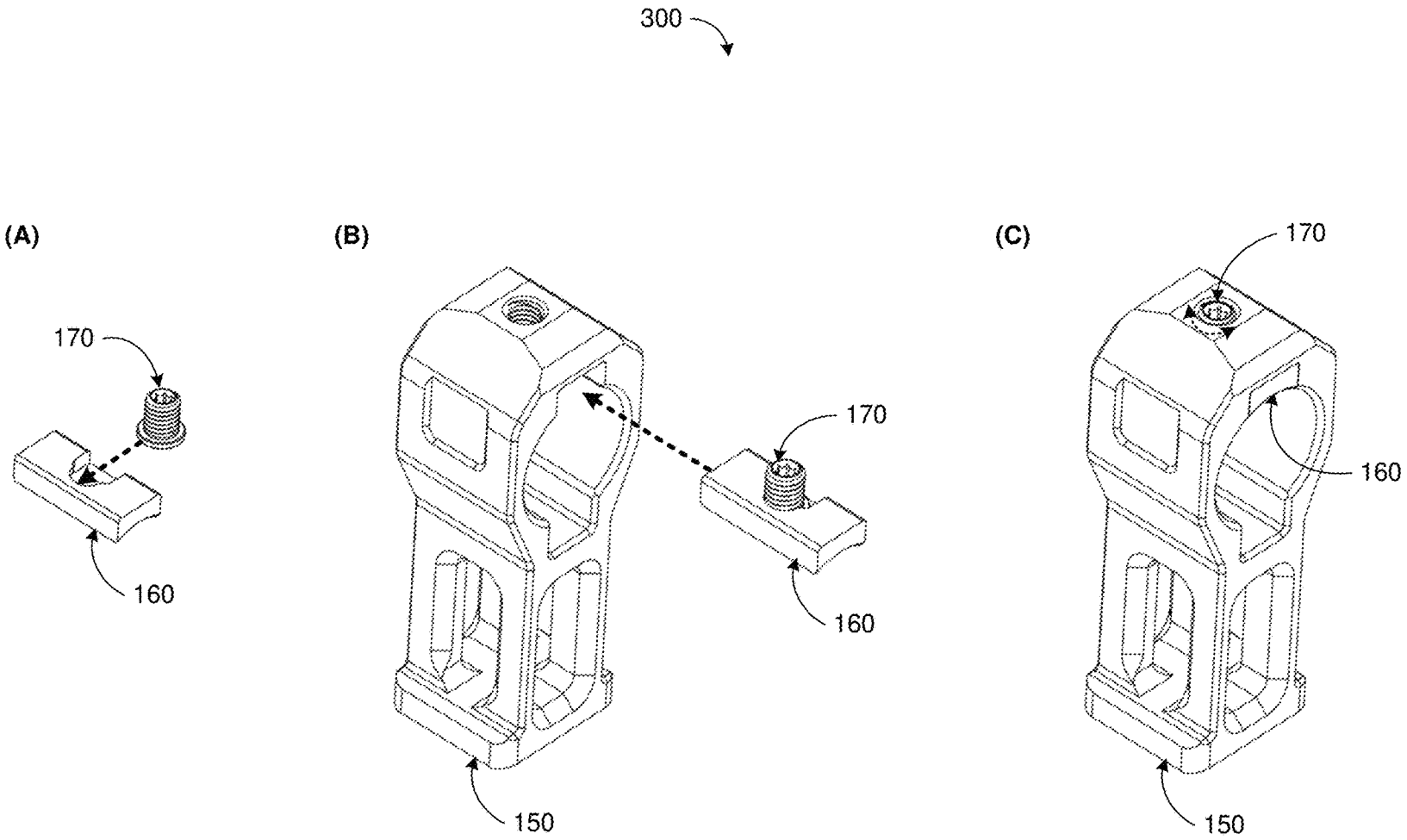
FIG. 3 is a diagram of an example scenario under a proposed scheme in accordance with an implementation of the present disclosure.

FIG. 3 illustrates an example scenario 300 as part of a process of assembling example assembly 100, subsequent to example scenario 200, under a proposed scheme in accordance with the present disclosure. Referring to FIG. 3, the adjustment screw 130 may be placed inside, or traverse through, the neck adjustable collar 160 to form an insert assembly. The insert assembly may slide into a slot on a lower side (or internal side) of a top portion (or top distal end) of the fixture neck 150. That is, the slot may be viewed as a groove or indentation on an inner wall of a through hole (or cylindrically-shaped hollow) of the fixture neck 150 through which the extension portion 120 of example apparatus 100 may traverse. As shown in FIG. 3, the top portion (or top distal end) of the fixture neck 150 may be configured with a screw hole for turning the adjustment screw 170 by the adjustment wrench. Next, the adjustment wrench may be used to turn, through the screw hole on the top portion (or top distal end) of the fixture neck 150, the adjustment screw 170 to move the adjustment screw 170 upwards to fasten the insert assembly (or the neck adjustable collar 160) onto the fixture neck 150. In some implementations, the neck adjustable collar 160 may be made of plastic. In other implementations, the neck adjustable collar 160 may be made of another material such as, for example, metal, alloy, ceramics, silicone, rubber or another type of polymer.

As shown in part (A) of FIG. 3, the adjustment screw 170 may be a custom-machined screw. A first distal end of the adjustment screw 170 may be configured with an indentation shaped suitably to render the adjustment screw 170 as a Torx screw (or Allen screw or Hex screw or another type of screw) to correspondingly receive or otherwise accommodate a working tip of the adjustment wrench to allow mating of the working tip of the adjustment wrench and the correspondingly-shaped indentation to turn the adjustment screw 170 clockwise and/or counterclockwise. A second distal end of the adjustment screw 170 (opposite the first distal end thereof) may be configured with a flange. As shown in part (A) of FIG. 3, the neck adjustable collar 160 may include an indentation to receive the second distal end of the adjustment screw 170 with the flange received in a slot that is wider than the indentation, as a diameter of the flange is greater than a diameter of a body of the adjustment screw 170 (which is between the first distal end and the second distal end of the adjustment screw 170). This allows the adjustment screw 170 to be mechanically coupled to the neck adjustable collar 160 after the adjustment screw 170 is slid into or otherwise received in the indentation of the neck adjustable collar 160 (and the flange received in the slot of the indentation), as shown in part (B) of FIG. 3. As shown in part (B) of FIG. 3, the neck adjustable collar 160 may be slidingly received in the groove or indentation on the inner wall of the through hole (or cylindrically-shaped hollow) of the fixture neck 150. As shown in part (C) of FIG. 3, when the adjustment screw 170 is turned by the adjustment wrench to move upwardly with respect to the fixture neck 150, the neck adjustable collar 160 also moves upwardly as it is pulled upwardly by the flange of the adjustment screw 170. Conversely, as shown in part (C) of FIG. 3, when the adjustment screw 170 is turned by the adjustment wrench to move downwardly with respect to the fixture neck 150, the neck adjustable collar 160 also moves downwardly as it is pushed downwardly by the flange of the adjustment screw 170.

Figure 4:
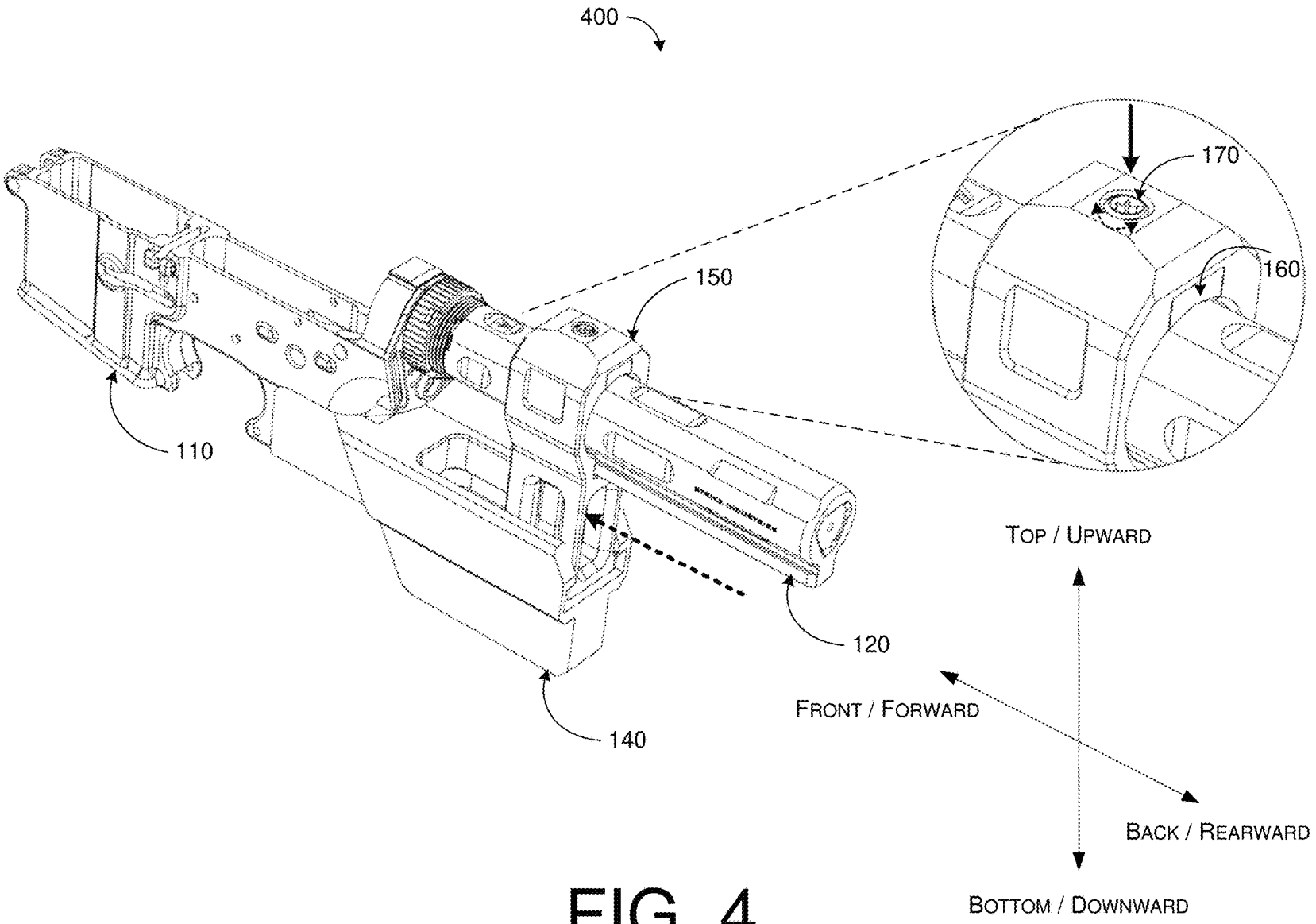
FIG. 4 is a diagram of an example scenario under a proposed scheme in accordance with an implementation of the present disclosure.

FIG. 4 illustrates an example scenario 400 as part of a process of assembling example assembly 100, subsequent to example scenario 300, under a proposed scheme in accordance with the present disclosure. Referring to FIG. 4, the fixture neck 150 may move longitudinally (in forward and rearward directions with respect to example apparatus 100) and be slidingly received in a slot in the fixture base 140, with the extension portion 120 traversing through the through hole (or cylindrically-shaped hollow) and moved to a suitable position as deemed appropriate by the user. The adjustment screw 170 may then be turned, either clockwise or counterclockwise, by the user to move the neck adjustable collar 160 downwardly or otherwise toward the extension portion 120, thereby clamping on the extension portion 120 to tighten a grip on the extension portion 120 by the fixture neck 150 and the neck adjustable collar 160. Conversely, the adjustment screw 170 may also be turned, either clockwise or counterclockwise, by the user to move the neck adjustable collar 160 upwardly or otherwise away from the extension portion 120, thereby loosening the grip on the extension portion 120 by the fixture neck 150 and the neck adjustable collar 160. Not shown in FIG. 4 may be a vise which may clamp on a lower portion of fixture base 140 so that the entire assembly shown in FIG. 4 may be secured or otherwise fixed by and on the vise to allow the user to perform maintenance, upkeep and/or repair of one or more components of the firearm.

Figure 5:
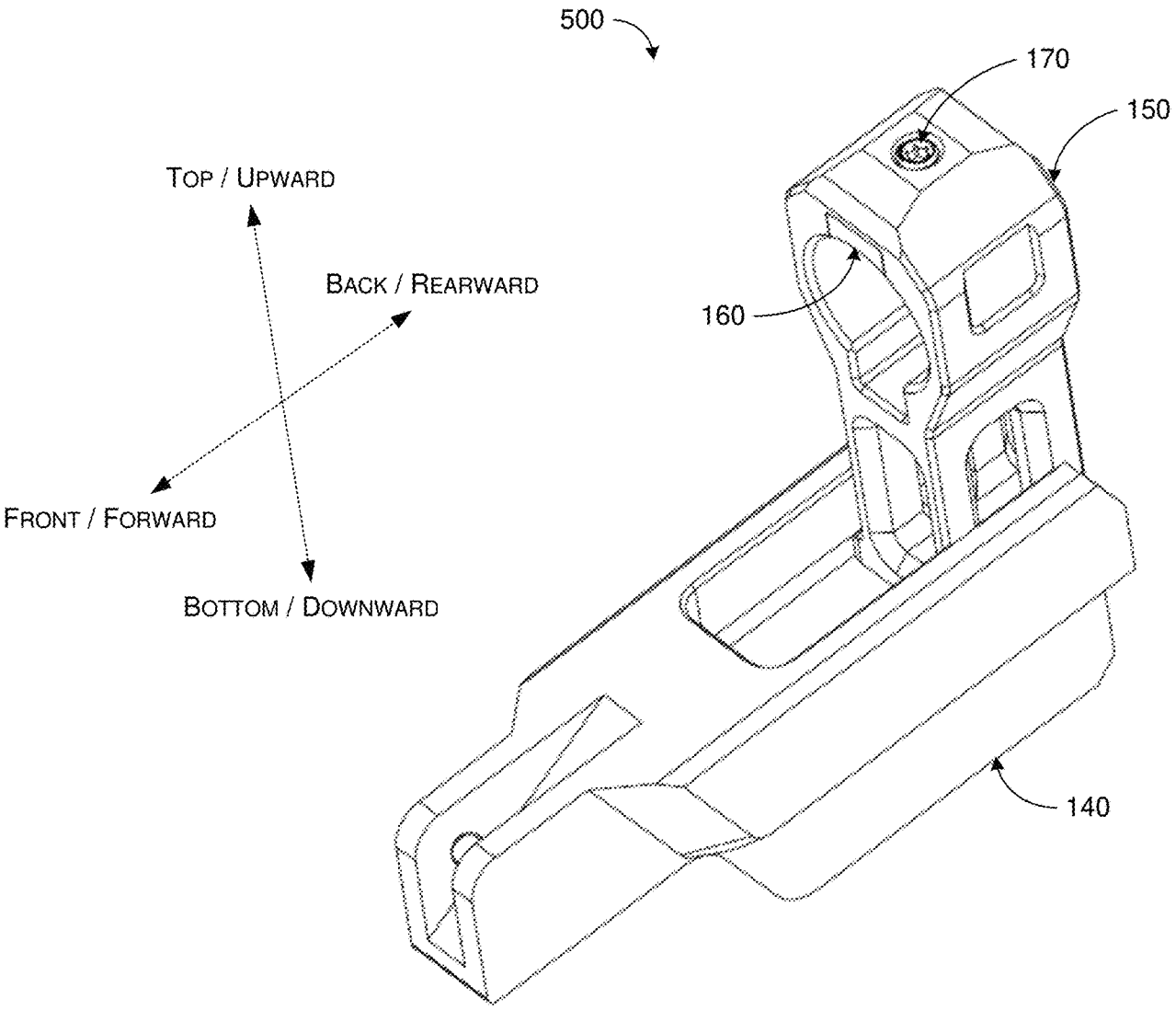
FIG. 5 is a diagram of an example scenario under a proposed scheme in accordance with an implementation of the present disclosure.

FIG. 5 illustrates an example scenario 500 as part of a process of assembling example assembly 100 under a proposed scheme in accordance with the present disclosure. FIG. 5 may pertain to a different perspective of the fixture base 140, fixture neck 150 and insert assembly (including neck adjustable collar 160 and adjustment screw 170) when assembled and in use (without the lower receiver 110 and extension portion 120 of the AR-15 or AR-10 style firearm in the figure so as to prevent visual obstruction).

Example Implementations

In view of the above, the proposed designs of a reflex sight may be implemented in many ways. For illustrative purposes and without limiting the scope of the present disclosure, a few example implementations of the proposed design are described below.

In one aspect, an apparatus implementable on a firearm (e.g., an AR-15 or AR-10 style firearm) may include a fixture base and a fixture neck. The fixture base may be configured to be attached to a location on a lower receiver of the firearm where a pistol grip is mounted when the firearm is in operation. The fixture neck may be configured to be slidingly received by the fixture base while an extension portion of the firearm traverses through a through hole or hollow of the fixture neck.

In some implementations, the fixture base may be configured with a lower portion and an upper portion. The fixture neck may be configured with a first distal end and a second distal end opposite the first distal end with ledges or extrudes protruding from opposite sides of the second distal end. Moreover, the through hole or hollow may be near the first distal end.

In some implementations, with the fixture base attached to the lower receiver, the fixture neck may be configured to be movably received in the upper portion of the fixture base while: (a) the ledges or extrudes are slidingly received in slots on opposite inner walls of the upper portion of the fixture base, and (b) the extension portion of the firearm traverses through the through hole or hollow of the fixture neck. In some implementations, a gap tolerance between the ledges or extrudes and the slots may be sufficiently large to the fixture base and the fixture neck to be used on firearms of different types and/or sizes.

In some implementations, the lower portion of the fixture base may be shaped to allow clamping onto two opposite sides of the lower portion by a vise.

In some implementations, the extension portion of the firearm may include a buffer tube of the firearm.

In some implementations, the apparatus may further include an adjustable collar and an adjustment screw. The adjustable collar may be configured to be received in a groove or indentation on an inner wall of the through hole or hollow of the fixture neck. The adjustment screw may be configured to move a position of the adjustable collar in the through hole or hollow of the fixture neck to tighten or loosen a grip on the extension portion by the fixture neck and the adjustable collar.

In some implementations, a first distal end of the adjustment screw may be configured with an indentation that is shaped to render the adjustment screw as a Torx screw, Allen screw or Hex screw. In some implementations, a second distal end of the adjustment screw opposite the first distal end may be configured to be received in an indentation on the adjustable collar. Moreover, the second distal end of the adjustable screw may be configured with a flange that is slidingly receivable in a slot on the adjustable collar that is wider than the indentation.

In another aspect, an apparatus implementable on a firearm (e.g., an AR-15 or AR-10 style firearm) may include a fixture base and a fixture neck. The fixture base may be configured with a lower portion and an upper portion, and the fixture base may be configured to be attached to a lower receiver of the firearm. The fixture neck may be configured with a first distal end and a second distal end opposite the first distal end. The fixture neck may be configured with a through hole or hollow near the first distal end. Moreover, the fixture neck may be configured with ledges or extrudes protruding from opposite sides of the second distal end. In some implementations, with the fixture base attached to the lower receiver, the fixture neck may be configured to be movably received in the upper portion of the fixture base while: (a) the ledges or extrudes are slidingly received in slots on opposite inner walls of the upper portion of the fixture base, and (b) an extension portion of the firearm traverses through the through hole or hollow of the fixture neck. In some implementations, a gap tolerance between the ledges or extrudes and the slots may be sufficiently large to the fixture base and the fixture neck to be used on firearms of different types and/or sizes.

In some implementations, the fixture base may be configured to attach to a location on the lower receiver where a pistol grip is mounted when the firearm is in operation.

In some implementations, when the fixture base is mounted on the lower receiver, the fixture base may be configured to be secured to the lower receiver by a grip screw that is used to mount the pistol grip on the lower receiver.

In some implementations, the extension portion of the firearm may include a buffer tube of the firearm.

In some implementations, the lower portion of the fixture base may be shaped to allow clamping onto two opposite sides of the lower portion by a vise.

In some implementations, the apparatus may further include an adjustable collar and an adjustment screw. The adjustable collar may be configured to be received in a groove or indentation on an inner wall of the through hole or hollow of the fixture neck. The adjustment screw may be configured to move a position of the adjustable collar in the through hole or hollow of the fixture neck to tighten or loosen a grip on the extension portion by the fixture neck and the adjustable collar.

In some implementations, a first distal end of the adjustment screw may be configured with an indentation that is shaped to render the adjustment screw as a Torx screw, Allen screw or Hex screw. In some implementations, a second distal end of the adjustment screw opposite the first distal end may be configured to be received in an indentation on the adjustable collar. Moreover, the second distal end of the adjustable screw may be configured with a flange that is slidingly receivable in a slot on the adjustable collar that is wider than the indentation.

In another aspect, an apparatus implementable on a firearm (e.g., an AR-15 or AR-10 style firearm) may include a fixture base, a fixture neck, an adjustable collar and an adjustment screw. The fixture base may be configured to be attached to a location on a lower receiver of the firearm where a pistol grip is mounted when the firearm is in operation. The fixture neck may be configured to be slidingly received by the fixture base while a buffer tube of the firearm traverses through a through hole or hollow of the fixture neck. The adjustable collar may be configured to be received in a groove or indentation on an inner wall of the through hole or hollow of the fixture neck. The adjustment screw may be configured to move a position of the adjustable collar in the through hole or hollow of the fixture neck to tighten or loosen a grip on the buffer tube by the fixture neck and the adjustable collar.

In some implementations, the fixture base may be configured with a lower portion and an upper portion. The fixture neck may be configured with a first distal end and a second distal end opposite the first distal end with ledges or extrudes protruding from opposite sides of the second distal end. The through hole or hollow may be near the first distal end.

In some implementations, with the fixture base attached to the lower receiver, the fixture neck may be configured to be movably received in the upper portion of the fixture base while: (a) the ledges or extrudes are slidingly received in slots on opposite inner walls of the upper portion of the fixture base, and (b) the extension portion of the firearm traverses through the through hole or hollow of the fixture neck. In some implementations, a gap tolerance between the ledges or extrudes and the slots may be sufficiently large to the fixture base and the fixture neck to be used on firearms of different types and/or sizes.

In some implementations, a first distal end of the adjustment screw may be configured with an indentation that is shaped to render the adjustment screw as a Torx screw, Allen screw or Hex screw. In some implementations, a second distal end of the adjustment screw opposite the first distal end may be configured to be received in an indentation on the adjustable collar. Moreover, the second distal end of the adjustable screw may be configured with a flange that is slidingly receivable in a slot on the adjustable collar that is wider than the indentation.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. An apparatus implementable on a firearm, comprising:

a fixture base configured to be attached to a location on a lower receiver of the firearm where a pistol grip is mounted when the firearm is in operation; and a fixture neck configured to be slidingly received by the fixture base while an extension portion of the firearm traverses through a through hole or hollow of the fixture neck, wherein:

the fixture base comprises a lower portion and an upper portion;

the fixture neck comprises a first distal end and a second distal end opposite the first distal end with ledges or extrudes protruding from opposite sides of the second distal end; and the through hole or hollow is near the first distal end, wherein, with the fixture base attached to the lower receiver, the fixture neck is configured to be movably received in the upper portion of the fixture base while:

the ledges or extrudes are slidingly received in slots on opposite inner walls of the upper portion of the fixture base, and the extension portion of the firearm traverses through the through hole or hollow of the fixture neck, wherein a gap tolerance between the ledges or extrudes and the slots allows the fixture base and the fixture neck to be used on firearms of different types or sizes.

2. The apparatus of claim 1, wherein the lower portion of the fixture base is shaped to allow clamping onto two opposite sides of the lower portion by a vise.

3. The apparatus of claim 1, wherein the extension portion of the firearm comprises a buffer tube of the firearm.

4. The apparatus of claim 1, further comprising:

an adjustable collar configured to be received in a groove or indentation on an inner wall of the through hole or hollow of the fixture neck; and an adjustment screw configured to move a position of the adjustable collar in the through hole or hollow of the fixture neck to tighten or loosen a grip on the extension portion by the fixture neck and the adjustable collar.

5. The apparatus of claim 4, wherein a first distal end of the adjustment screw is configured with an indentation that is shaped to render the adjustment screw as a Torx screw, Allen screw or Hex screw.

6. The apparatus of claim 5, wherein a second distal end of the adjustment screw opposite the first distal end is configured to be received in an indentation on the adjustable collar, and wherein the second distal end of the adjustable screw is configured with a flange that is slidingly receivable in a slot on the adjustable collar that is wider than the indentation.

7. An apparatus implementable on a firearm, comprising:

a fixture base comprising a lower portion and an upper portion, the fixture base configured to be attached to a lower receiver of the firearm; and a fixture neck comprising a first distal end and a second distal end opposite the first distal end, the fixture neck configured with a through hole or hollow near the first distal end, the fixture neck further configured with ledges or extrudes protruding from opposite sides of the second distal end, wherein, with the fixture base attached to the lower receiver, the fixture neck is configured to be movably received in the upper portion of the fixture base while:

the ledges or extrudes are slidingly received in slots on opposite inner walls of the upper portion of the fixture base, and an extension portion of the firearm traverses through the through hole or hollow of the fixture neck, wherein a gap tolerance between the ledges or extrudes and the slots allows the fixture base and the fixture neck to be used on firearms of different types or sizes.

8. The apparatus of claim 7, wherein the fixture base is configured to attach to a location on the lower receiver where a pistol grip is mounted when the firearm is in operation.

9. The apparatus of claim 8, wherein, when the fixture base is mounted on the lower receiver, the fixture base is configured to be secured to the lower receiver by a grip screw that is used to mount the pistol grip on the lower receiver.

10. The apparatus of claim 7, wherein the extension portion of the firearm comprises a buffer tube of the firearm.

11. The apparatus of claim 7, wherein the lower portion of the fixture base is shaped to allow clamping onto two opposite sides of the lower portion by a vise.

12. The apparatus of claim 7, further comprising:

an adjustable collar configured to be received in a groove or indentation on an inner wall of the through hole or hollow of the fixture neck; and an adjustment screw configured to move a position of the adjustable collar in the through hole or hollow of the fixture neck to tighten or loosen a grip on the extension portion by the fixture neck and the adjustable collar.

13. The apparatus of claim 12, wherein a first distal end of the adjustment screw is configured with an indentation that is shaped to render the adjustment screw as a Torx screw, Allen screw or Hex screw.

14. The apparatus of claim 13, wherein a second distal end of the adjustment screw opposite the first distal end is configured to be received in an indentation on the adjustable collar, and wherein the second distal end of the adjustable screw is configured with a flange that is slidingly receivable in a slot on the adjustable collar that is wider than the indentation.

15. An apparatus implementable on a firearm, comprising:

a fixture base configured to be attached to a location on a lower receiver of the firearm where a pistol grip is mounted when the firearm is in operation;

a fixture neck configured to be slidingly received by the fixture base while a buffer tube of the firearm traverses through a through hole or hollow of the fixture neck;

an adjustable collar configured to be received in a groove or indentation on an inner wall of the through hole or hollow of the fixture neck; and an adjustment screw configured to move a position of the adjustable collar in the through hole or hollow of the fixture neck to tighten or loosen a grip on the buffer tube by the fixture neck and the adjustable collar.

16. The apparatus of claim 15, wherein:

the fixture base comprises a lower portion and an upper portion;

the fixture neck comprises a first distal end and a second distal end opposite the first distal end with ledges or extrudes protruding from opposite sides of the second distal end; and the through hole or hollow is near the first distal end.

17. The apparatus of claim 16, wherein, with the fixture base attached to the lower receiver, the fixture neck is configured to be movably received in the upper portion of the fixture base while:

the ledges or extrudes are slidingly received in slots on opposite inner walls of the upper portion of the fixture base, and the extension portion of the firearm traverses through the through hole or hollow of the fixture neck, wherein a gap tolerance between the ledges or extrudes and the slots allows the fixture base and the fixture neck to be used on firearms of different types or sizes.

18. The apparatus of claim 15, wherein a first distal end of the adjustment screw is configured with an indentation that is shaped to render the adjustment screw as a Torx screw, Allen screw or Hex screw, wherein a second distal end of the adjustment screw opposite the first distal end is configured to be received in an indentation on the adjustable collar, and wherein the second distal end of the adjustable screw is configured with a flange that is slidingly receivable in a slot on the adjustable collar that is wider than the indentation.

* * * * *